United States Patent [19]

Miyazaki

[11] Patent Number: 4,898,231

[45] Date of Patent: Feb. 6, 1990

[54] HEAT-PIPE SYSTEM AND METHOD OF AND APPARATUS FOR CONTROLLING A FLOW RATE OF A WORKING FLUID IN A LIQUID PIPE OF THE HEAT PIPE SYSTEM

[75] Inventor: Yoshiro Miyazaki, Tokyo, Japan

[73] Assignee: Kabushiki Kaisha Toshiba, Kawasaki, Japan

[21] Appl. No.: 285,311

[22] Filed: Nov. 10, 1988

Related U.S. Application Data

[63] Continuation of Ser. No. 913,389, Sep. 30, 1986, abandoned.

[30] Foreign Application Priority Data

Sep. 30, 1985 [JP] Japan ..... 60-215140
Jun. 2, 1986 [JP] Japan ..... 61-125822

[51] Int. Cl.[4] ..... F28D 15/02; F28F 27/00

[52] U.S. Cl. ..... 165/13; 165/32; 165/104.25

[58] Field of Search ..... 165/104.25, 104.24, 165/13, 32; 122/366

[56] References Cited

U.S. PATENT DOCUMENTS 4,422,501 12/1983 Franklin et al. ..... 165/104.26
4,470,450 9/1984 Bizzell et al. ..... 165/104.25
4,583,582 4/1986 Grossman ..... 165/32

FOREIGN PATENT DOCUMENTS 80086 5/1985 Japan ..... 165/32
80089 5/1985 Japan ..... 165/32

OTHER PUBLICATIONS

Experimental Feasibility Study of Water-Filled Capillary-Pumped Heat-Transfer Loops, F. J. Stenger, NASA-TM-X-1310, (1966).
Design and Test of a Two-Phase Monogroove Cold Plate; F. Edelstein et al., AIAA-85-019, (1985).
Externally Pumped Rankine Cycle Thermal Transport Devices; R. J. Hannemann; AIAA-79-1091; (1979).

*Primary Examiner*—Albert W. Davis, Jr.
*Attorney, Agent, or Firm*—Foley & Lardner, Schwartz, Jeffery, Schwaab, Mack, Blumenthal & Evans

[57] ABSTRACT

A heat-pipe system of the two-phase fluid loop type comprising a liquid duct as a main loop for circulating a working fluid in liquid phase by a pump, an evaporator having a first capillary structure to which the working fluid is supplied from high pressure side of the main loop, a condenser having a second capillary structure for returning liquid condensate to the low pressure side of the man loop after radiating heat in the condenser, and a bypass pipe connected between the evaporator and the radiator for transporting vapor evaporated in the evaporator through its capillary structure to the second capillary of the condenser. With this construction, since the working fluid is circulated by the pump while the supply of the liquid corresponding to that evaporated in the capillary structure of the evaporator is carried out by the capillary force in the evaporator, a large amount of heat can be transported over long distances. A method of and apparatus for controlling a flow rate of a working fluid in a liquid duct of the heat-pipe system is also disclosed.

4 Claims, 8 Drawing Sheets

HEAT-PIPE SYSTEM AND METHOD OF AND APPARATUS FOR CONTROLLING A FLOW RATE OF A WORKING FLUID IN A LIQUID PIPE OF THE HEAT PIPE SYSTEM

This application is a continuation of application Ser. No. 913,389, filed Sept. 30, 1986, now abandoned.

BACKGROUND OF THE INVENTION

1. Field of the Invention

The present invention relates to a heat-pipe system particularly to an externally pumped heat-pipe system of the two-phase fluid loop type for transport of heat by thermodynamic cycles involving the phase changes between evaporation and condensation, and a method for controlling a flow rate of a working fluid in a liquid pipe, so as to optimally control the fluid remaining in the capillary structure of an evaporator.

2. Description of the Prior Art

As a heat transport system such as a space station, a fluid loop is useful in view of the demand of large heat load capability for transport. In a single phase fluid loop, however, since heat is transported by use of radiated heat, a large amount of working fluid has to be circulated in order to maintain the temperature of a heating portion within a narrow temperature range. As a result, a large scale piping and pumping system is required so that it is not practical in view of weight as well as pumping power.

Accordingly, when large amounts of heat should be transported with less pumping power and the temperature of the heating portion should be maintained at a narrow temperature range, the two-phase fluid loop is considered useful, which transports heat by using latent heat due to changes in phase of the working fluid.

According to the system described above, since the latent heat is used in the two-phase fluid loop, the circulating amount of the working fluid can be reduced, thus enabling the piping and pumping system to be minituarized and light in weight as well as enabling use of a small driving power for circulation of the fluid, with sufficient practicality.

In the two-phase fluid loop, the circulating fluid is transported in liquid phase to heat radiating portions of electronics, where it is transformed into vapor phase by heat absorption. The vapor phase is transferred to a heat radiation portion, where heat is radiated and it is again returned to the liquid phase.

As one method for circulating such two-phase working fluids is described above, there are mainly two methods; one is a method of using, for instance, a mechanically pumped system and the other is a method of using a capillary-pumped system.

FIG. 1 shows the two-phase fluid loop using conventional mechanical pumps. The two-phase fluid loop is comprised of a condenser 101 as a heat radiating means, an a evaporator 103 as heat absorbing means, a mechanical pump 105 for driving the working fluid and a regulating valve 107.

The vapor which has absorbed heat from electronics and evaporated in the evaporator 103 as a heat absorbing means, is transported to the condenser 101 as a heat radiating means via a conduit, where heat is radiated and it is condensed. The liquid thus condensed is returned by the mechanical pump 105.

The two-phase fluid loop thus constructed has a capability for transporting a large heat load over a long distance with a small pump. In addition, the number of rotations or ratational speed of the pump and the operation of the regulating valve can be actively controlled as well as being able to deal with large thermal fluctuations.

On the other hand, however, in the flow where vapor phase and liquid phase coexist, various instabilities of the flow as well as oscillating phenomena will tend to occur. For instance, in the evaporator duct, there will occur a drooping type unstable condition wherein the flow rate becomes unstable in a negative zone of pressure loss against the increase in the flow rate and other different unstable flowing phenomena.

In the condenser as well, in the portion where vapor flows into super-cooling water, for instance, oscillations involving the condensation of vapor in liquid will tend to occur. Therefore, it is extremely difficult to carry out a stable control of the basically unstable two-phase fluid loop. Moreover, since the characteristics of the two-phase fluid are not clearly known in a zero-gravity state, the control of the two-phase fluid loop becomes a difficult problem. There are also problems of cavitation of a working fluid, lubrication of motors and reliability.

For the purpose of overcoming these problems, a capillary pumped system has been proposed heretofore, which is the two-phase fluid loop in which the amount of the evaporated liquid is automatically supplemented by capillary pumping power similar to heat-pipes.

FIG. 2 shows, by way of example, a capillary pumped heat transfer loop system according to the prior art. The loop system comprises a capillary structure 201*a*, that is, a wick provided at an evaporator 201 as a heat absorbing means and covering the inner walls, so as to pull in the working liquid contained in the condenser duct 203 as a heat radiating means by a capillary force.

The capillary pumped heat transfer loop system thus constructed, eliminates the necessity of an externally supplied pumping power for driving the working fluid as well as automatically supplying the amound of fluid corresponding to the evaporated amount thereof. In this capillary pumped heat transfer loop system, however, since the working fluid driving power resorts only to the capillary pumping, the fluid transport capacity is small and there is a problem in that it is difficult to transport large amounts of heat over long distances.

Moreover, the capillary structure of the heat-pipe according to the prior art is comprised of grooves and metal meshes and it has two functions; one is generation of the capillary force or capillary action so as to transport the condensate to an evaporator and the other is passage of the liquid to the condenser by the capillary force. In addition, the gap dimension of the capillary structure is perferably made small because of the generation of the capillary force while it is preferable to make the liquid channel large, so that these two points constitute an antipathetic relationship with each other. Accordingly, the gap dimension of the capillary structure is designed so as to balance the relationship. For this reason, the conventional heat pipe cannot increase the maximum flow rate of the condensate too much, thus limiting the heat transport capillary.

On the other hand, a capillary pumped system and monogroove heat-pipes which are a kind of an arterial heat-pipe have been proposed wherein only a capillary force generation function is provided in the capillary structure while a passage for transporting condensate is provided separately. These capillary pumped systems and monogroove heat pipes have some merits that external pumping power for circulating the working fluid can be omitted as well as having a self control function that the same amount of liquid as evaporated is supplied. In this system, however, since the fluid driving power resorts to the capillary force, the liquid transport capillary cannot be increased so large that it is not sufficient to transport a large amount of heat over a long distance.

As described in the foregoing, maximum flow rate of condensate cannot be increased in the heat-pipe according to the prior art and the heat transport capillary is limited. In addition, in the system wherein the amount of liquid in the evaporator is detected by an ultrasonic sensor, a valve for supplying the liquid is opened in accordance with the detected signal, and the liquid is supplied by the drive of the pump, a control mechanism and the system as a whole become complex while reliability of endurance becomes lowered.

In the mechanically pumped heat-pipe system, however, the so-called "dry out" phenomenon is produced in which the same amount of liquid corresponding to the evaporated amount of the liquid in the evaporator is not supplied to the evaporator, while when an amount of the liquid more than the evaporated amount thereof is supplied, an excessive liquid state occurs, thus lowering the heat transport efficiency for both cases. Consequently, an accurate liquid amount has to be supplied to the evaporator and how to control the liquid supply amount becomes an important problem.

As one approach for suitably controlling the liquid supply to the evaporator, it has been proposed that the residual liquid amount in the liquid channel of the evaporator is detected by an ultrasonic sensor, a liquid supply valve is opened in response to a detected signal from the sensor, and the liquid is supplied by a pump (see, for instance, "Design and Test of a Two-Phase Monogroove Cold Plate", AIAA 20th Thermophysics Conference, June 19–21, 1985).

In this structure according to the prior art, however, there are the following problems; when a flow rate in the liquid channel of the evaporator is decreased at a predetermined flow rate, an ultrasonic sensor detects this condition and transmits a command for the supply of liquid. Because of this construction, the starting and stopping of the pump as well as the opening and closing of the valve have to be intermittently and frequently carried out.

For these reasons, its control mechanism and system become complex and the reliability and endurance become lowered. In addition when the liquid amount in the liquid channel of the evaporator is decreased, there will occur discontinuity of the liquid between the vapor phase and liquid phase, with the result that a "dry out" phenomenon will occur on the evaporation surface. In order to prevent this phenomenon, a capillary structure which permits the liquid channel to communicate with the vapor surface other than the capillary structure provided on the evaporation surface.

SUMMARY OF THE INVENTION

It is therefore an object of the present invention to overcome the above drawbacks according to the prior art and to provide an externally pumped heat-pipe system in which a large amount of heat can be transported over long distances and yet it is capable of stably controlling the working fluid even in a zero gravity state such as in space.

It is another object of the present invention to provide an externally pumped heat-pipe system in which a large amount of heat can be transported over long distances by the drive of a pump while a suitable amount of liquid can be supplied by a successive control of the liquid, in accordance with the evaporated amount in the evaporator.

It is still another object of the present invention to provide a heat-pipe system in which the flow rate of a working fluid in fluid channels is suitably controlled in accordance with the actual conditions of an evaporator, detected by detecting means so as to optimally control the amount of liquid remaining in the capillary structure of the evaporator.

It is yet another object of the present invention to provide a method of controlling the flow rate of a working fluid in liquid channels of a heat-pipe, particularly an arterial heat pipe in which the flow rate of the working fluid can be suitably controlled by a control unit having a CPU and a ROM, a RAM, in accordance with the actual operating conditions in an evaporator, detected by detecting means so as to optimally control the amount of the liquid remaining in the capillary structure of the evaporator.

One feature of the present invention resides in a heat-pipe system comprising: a liquid duct as a main loop for circulating a working fluid in liquid phase by means of a pump; an evaporator having a first capillary structure to which the working fluid is supplied from a high pressure side of the main loop; a condenser having a second capillary structure for returning condensate to the low pressure side of the main loop after radiating heat in the condenser, and a bypass pipe communicating between the evaporator and the condenser for the transport of vapor evaporated in the evaporator to the condenser, thereby transporting a large amount of heat over long distances.

Another feature of the present invention resides in a heat-pipe system which comprises: an evaporator having a first capillary structure for evaporating a working fluid; a condenser having a second capillary structure for condensing vapor evaporated in the evaporator into liquid condensate so as to return it to the evaporator through a liquid duct; a vapor transport pipe communicating between vapor channels of the evaporator and the condenser, for transporting vapor evaporated in the evaporator; a pump provided at the liquid duct for driving the working fluid flowing therethrough; sensor means for detecting the change in the amount of liquid remaining in the capillary structure of the evaporator in accordance with the pressure difference between vapor pressure in the vapor channel and liquid pressure in the liquid channel of the evaporator; and control means having a CPU, a ROM, and a RAM, connected between the pump and the sensor means for controlling the rotational speed of the pump in accordance with detected signals from said sensor means so as to optimally control the amount of the liquid remaining in the capillary structure of the evaporator by controlling a flow rate of the liquid flowing through the liquid duct.

Still another feature of the present invention resides in a method of controlling the flow rate of a working fluid in a liquid of a heat-pipe system having an evaporator and condensor of the arterial monogroove heat pipe type, which comprises the steps of: detecting the position of interface between the vapor and liquid in an elongated pipe of a sensor means for detecting the liquid amount therein; calculating $P_V - P_L$ (where $P_V$=vapor pressure in the vapor channel, $P_L$=liquid pressure in the liquid channel of the evaporator) from the difference between capillary force Pcap in the elongated pipe of the sensor means and the head height due to the self weight of the liquid in the elongated pipe; determining if $P_V-P_L<\Delta$ Pcap. max is found (where $\Delta$ Pcap. max=maximum capillary force in the vapor channel of the evaporator); increasing the rotational speed of a pump provided at the liquid duct if the result of the determination is NO and repeating this operation until it reaches a desired result; determining if $0<P_V-P_L$ is found, in accordance with the result of the first determination, i.e., YES is found; decreasing the rotation speed of the pump if the result of the last determination is NO, i.e., $0\geqq P_V-P_L$ is found; and returning the operation to the first step of detecting the position of interface when the last determination is affirmative.

These and other objects, features, and advantages will be better understood from the following description of the invention with reference to the accompanying drawings.

DESCRIPTION OF THE PREFERRED EMBODIMENT

Figure 1:
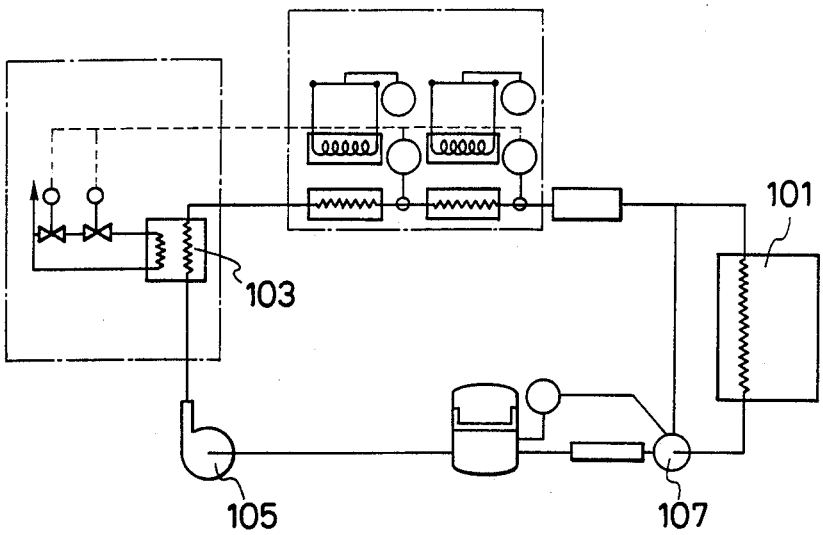
FIG. 1 (PRIOR ART)
FIG. 1 is a brief construction of a two-phase fluid loop according to the prior art using a mechanically pumped system.
Figure 2:
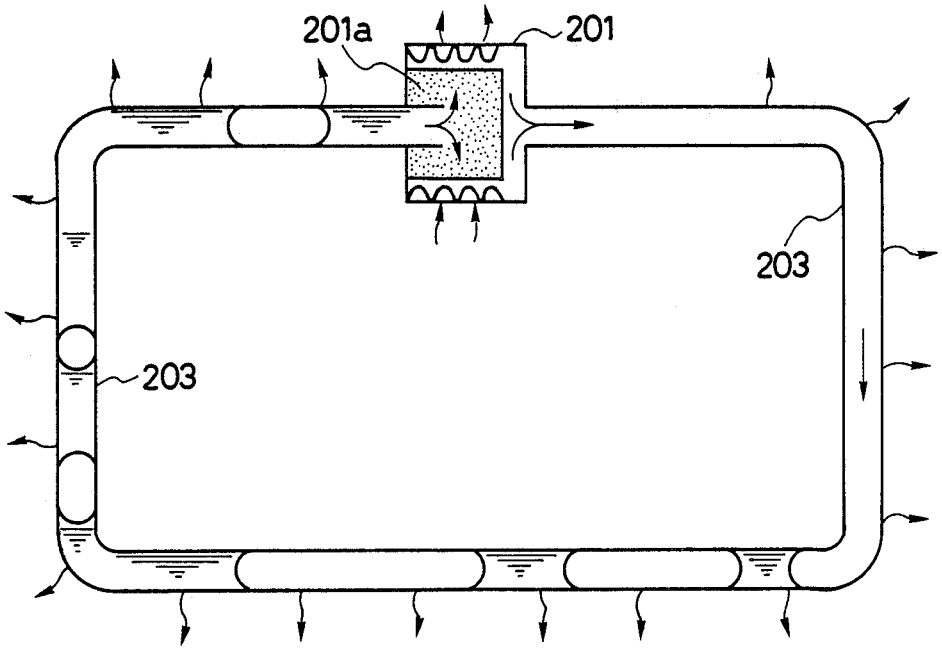
FIG. 2 (PRIOR ART)
FIG. 2 is a brief construction of a capillary pumped system according to the prior art.
Figure 3:
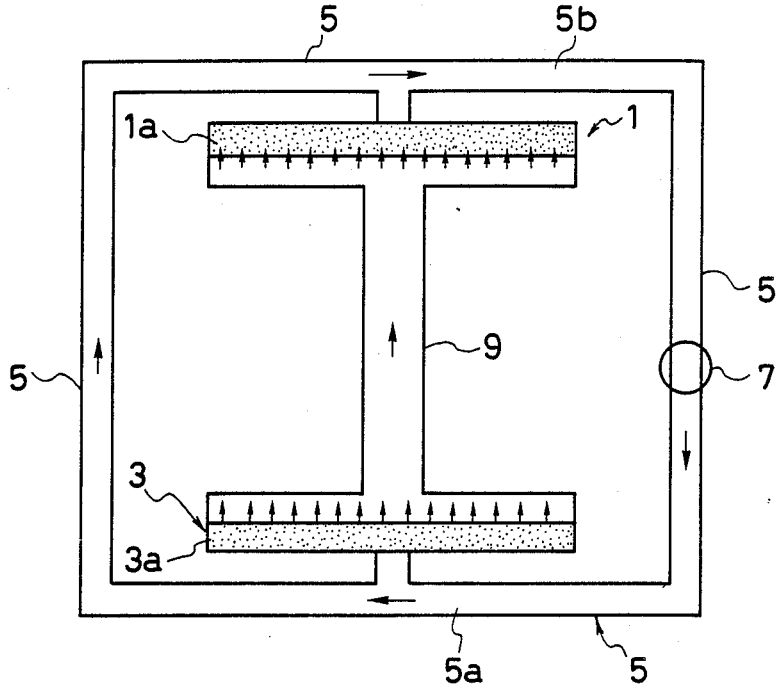
FIG. 3 is an overall construction of the capillary pumping system of the two-phase fluid loop type, according to the present invention.

Refering to FIG. 3, the heat-pipe system of the two-phase fuid loop constituting a capillary pumping system according to the present invention comprises a condenser 1 as heat radiating means for radiating heat to space, an evaporator 3 as heat absorbing means for evaporating a working fluid in liquid phase by absorbing heat from electronic devices, a main loop 5 for circulating the working fluid, a pump 7 for imparting driving power so as to circulate liquid, and a bypass pipe 9.

The evaporator 3 comprises a capillary structure or wick 3*a* which is coupled to the high pressure side 5*a* of a main loop 5 and the capillary structure 3*a* contacts the working fluid on the high pressure side 5*a*. Similarly, the condenser 1 comprises a capillary structure 1*a*, i.e., wick which is coupled to the low pressure side 5*b* of the main loop and the capillary structure 1*a* contacts the working fluid on the low pressure side 5*b*. The evaporator 3 and the condenser 1 are communicated with each other by the bypass pipe 9 which transports vapor evaporated in the evaporator 3.

The operation of the heat-pipe system of the two-phase fluid loop type according to the present invention will now be described.

The working fluid in the liquid phase within the main loop 5 is circulated in the main loop 5 by the driving force of the pump 7. The working fluid within the high pressure side 5*a* of the main loop 5 is introduced by the capillary structure 3*a* in the evaporator 3. The working fluid in the liquid phase thus introduced is evaporated in the evaporator 3 by absorbing heat from the electronics.

The vapor phase evaporated in the evaporator reaches the condenser 1 at low temperature via the bypass pipe 9. The pressure difference between the bypass pipe 9 and the low pressure side 5*a* of the main loop permits the vapor phase to be entered in the capillary structure 1*a* of the condenser 1, where heat is radiated and it is condensed into the liquid phase again, thereby returning to the main loop 5 from the low pressure side 1*a*.

Figure 4:
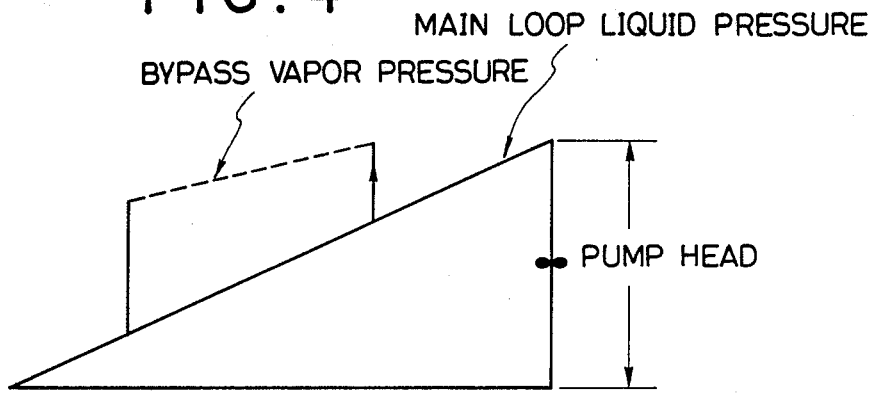
FIG. 4 is a pressure distribution model of each fluid loop of the capillary pumping system of FIG. 3.

In the evaporator 3, the same amount of liquid as that evaporated in the evaporator 3 is taken from the high pressure side of the main loop 5 by the capillary action in the capillary structure 3*a*. In this case, the pressure displacement between the bypass pipe 9 and the main loop 5 becomes the characteristic as indicated in FIG. 4, thus supporting the above operation.

In the manner as described above, a driving force is imparted to the working fluid in the main loop 5 by the pump 7, so that a large amount of heat is transported over long distances.

Moreover, since the supply of the liquid evaporated in the evaporator 3 is carried out by the capillary force of the capillary structure or wick 3*a*, a stable control can be easily performed in the heat-pipe system according to the present invention.

In addition, since the liquid phase is circulated in the main loop while the vapor phase flows through the bypass pipe 9 and since there is no portion where the vapor phase and the liquid phase flow in a mixed condition, phenomena such as unstable flowing never occurs even in a no gravity state like cosmic space, thus realizing a stable control of the system.

The foregoing description of the present invention illustrates an embodiment relating to the two-phase fluid loop system. However, it is to be appreciated that the structures of the condenser 1 and the evaporator 3 as well as those of the main loop 5 and the bypass pipe 9 may be constructed in other desired forms.

Figure 5:
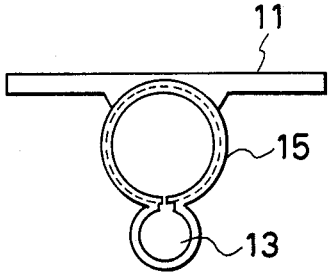
FIG. 5 illustrates a cross section of an arterial heat-pipe for use in the capillary pumping system according to the present invention.

FIG. 5 shows one example of the structure of the evaporator and condenser, which uses monogroove heat-pipes having a cross section with a slit which communicates a vapor channel 15 having a fin 11 and the liquid channel 13.

Figure 6:
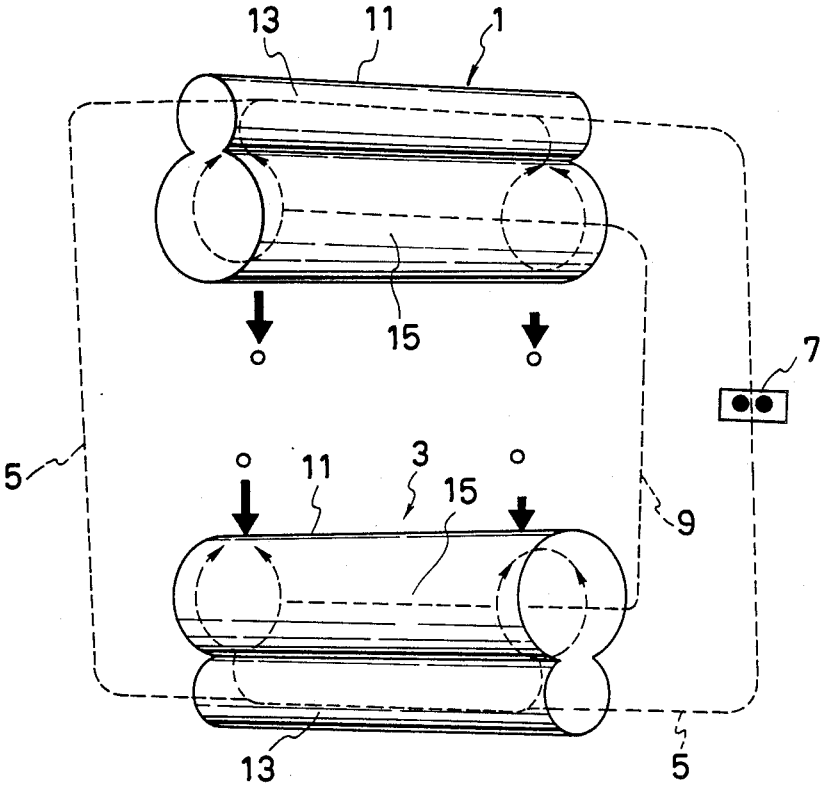
FIG. 6 illustrates the capillary pumping system realized by the arterial heat-pipe system shown in FIG. 5.

FIG. 6 shows a heat-pipe system using the monogroove heat-pipes as shown in FIG. 5, according to the present invention. In this system, the liquid channels 13, 13 of the monogroove heat pipes having a capillary structure therein respectively are connected to a liquid duct as the main loop 5, so as to construct the condenser 1 and the evaporator 3, while the vapor channels 15, 15 of the monogroove heat-pipes are connected to the bypass pipe communicating the condenser 1 with the evaporator 3. Reference numeral 7 indicates a pump corresponding to the pump 7 in FIG. 3.

In the heat-pipe system according to the present invention, since the drive force for driving the working fluid in the main loop is imparted by a pump, large heat loads can be transported over long distances as well as automatically supplying liquid evaporated in the evaporator by the capillary pumping of the evaporator, thus enabling the supply of the liquid to be easily controlled.

Moreover, since there is no flowing portion where vapor phase and liquid phase are mixed and flowing through the same single duct, flowing instability never occurs even in a zero state gravity such as in the cosmic space, thus realizing a stable control of the fluid.

Figure 7:
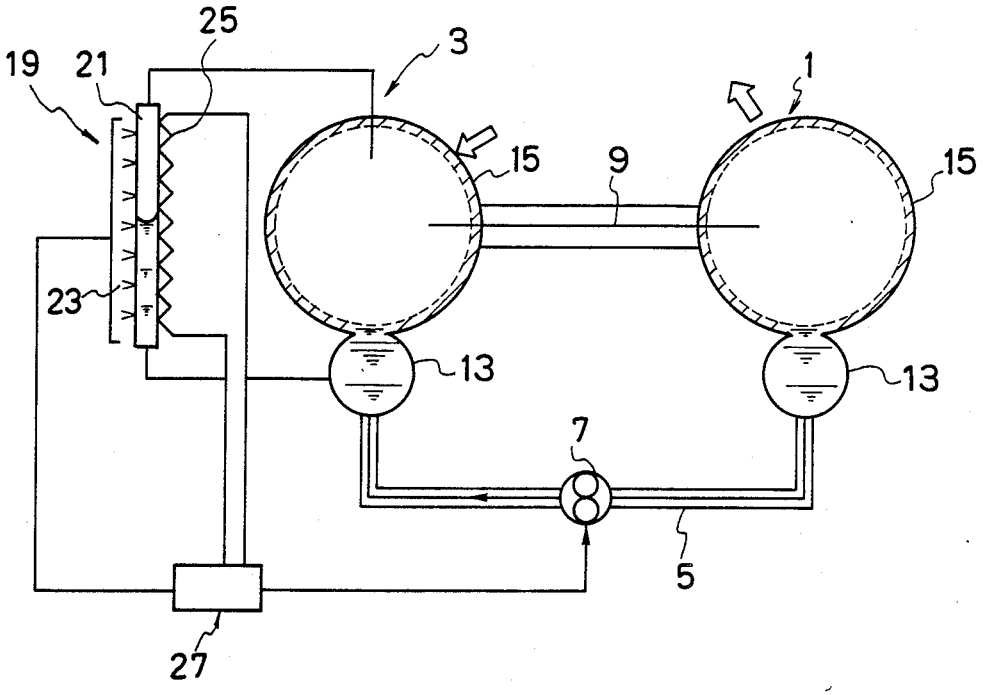
FIG. 7 is a heat-pipe system as one embodiment according to the present invention.

FIG. 7 shows a third embodiment of the heat-pipe system according to the present invention.

The heat-pipe system comprises an evaporator 3 for evaporating the working fluid by absorbing heat from electronics devices, a condenser 1 for radiating heat to the atmosphere, which consists of vapor channels 15, 15' and liquid channels 13, 13' of the monogroove heat pipes. The vapor channels 15, 15' and the liquid channels 13, 13' are of the same length, and each pair of channels 15, 15', 13, 13' is communicated with each other in the slot in part in the peripheral direction over the entire length. Although not shown, each of the vapor channels 15, 15' has the capillary structure respectively, which corresponds to 1*a* or 3*a* in FIG. 3.

The capillary structure has circumferential grooves provided over the entire inner surface peripheral direction as well as axial grooves, the end of which is communicated with the liquid channel 13, 13', respectively. The circumferential grooves are provided with a predetermined distance spaced apart in the axial direction of the vapor channels 15, 15'. The axial grooves are provided in the axial direction of the vapor channels 15, 15' with a predetermined interval over the entire inner surface thereof. The two types of grooves are communicated each other in a crossed condition. The vapor channel 15 of the evaporator 3 is communicated with the vapor channel 15' of the condenser 3 through the vapor pipe 9 which corresponds to the bypass pipe 9 in FIG. 3.

The liquid channel 13 of the evaporator 3 is communicated with the liquid channel 13' of the condenser 1 through the liquid duct 5. The liquid duct 5 has a function for returning condensate from the condenser 1 to the evaporator 1, with a pump 7 being provided therebetween so as to circulate the condensate.

In this embodiment, a sensor 19 is provided at the evaporator 3, which detects the change in the pressure difference between the vapor pressure in the vapor channel 15 and the liquid pressure in the liquid channel 13 in accordance with the change in the liquid amount existing in the capillary structure in the evaporator 3. Namely, the sensor 19 comprises an elongated pipe 21 extending substantially in the vertical direction and a plurality of thermocouples 23 for detecting the level of the liquid in the elongated pipe 21 through the temperature detection of the liquid, the thermocouples being provided along the elongated pipe 21.

The elongated pipe 21 is communicated to vapor within the vapor channel 15 at one end and to liquid within the liquid channel 13 at the other end. There is also provided along the elongated pipe 21 a heater 25 for heating the pipe 21. The thermocouples 23 and the heater 25 are connected to a control unit 27 which controls the pump 17 in accordance with parameters detected by the thermocouples. That is, the control unit 27 comprises a microprocessor having a ROM, a RAM, and a CPU, which controls the flow rate of the liquid in the liquid duct 5 by controlling the rotational speed of the pump 7 so as to suitably control the liquid remaining in the capillary structure of the evaporator 3 in accordance with the output signal from the sensor 19.

The operation of the heat-pipe system according to the present invention shown in FIG. 7 will now be described.

A suitable amount of liquid is maintained in the capillary structure of the evaporator 3 by its capillary force from the liquid channel 13. That is, the working fluid in the liquid channel 13 is sucked up by a plurality of circumferential grooves within the vapor channel 15 while the liquid thus sucked up is led in the axial direction by the plurality of the axial grooves which are communicated with the circumferential grooves.

Now, the working fluid in the vapor channel 15 is evaporated by the heat absorption during the cooling of electronics and the vapor is introduced in the vapor channel 15 of the condensor 1 through the vapor transport pipe 9. Condensation occurs in the vapor channel 15 due to heat radiation to the atmosphere and the condensate is led to the liquid channel 13'. The condensate within the liquid channel 13' is driven by the pump 7 and it is returned to the liquid channel 13 of the evaporator 3.

In this case, supposing that vapor pressure within the vapor channel 15 is $P_V$ liquid pressure within the liquid channel 13 is $P_L$, and maximum capillary force within the vapor channel 15 is Pcap. max, the following equations must be satisfied;

$$P_V - P_L < Pcap.max \quad (1)$$

$$P_V - P_L < 0 \quad (2)$$

Unless the equation (1) is not satisfied, the liquid within the vapor channel 15 is pushed into the liquid channel 13, thus producing so-called "dry out" state. On the other hand, if the equation (2) is not satisfied, the liquid pressure $P_L$ becomes higher than the vapor pressure $P_V$ and the normal evaporation action is no longer carried out in the vapor channel 15 as a result of a large amount of flow into the vapor channel 15 from the liquid channel 13. According to the present invention, therefore, the necessary conditions of the equations (1) and (2) are maintained by the control of the control unit 27.

Figure 8:
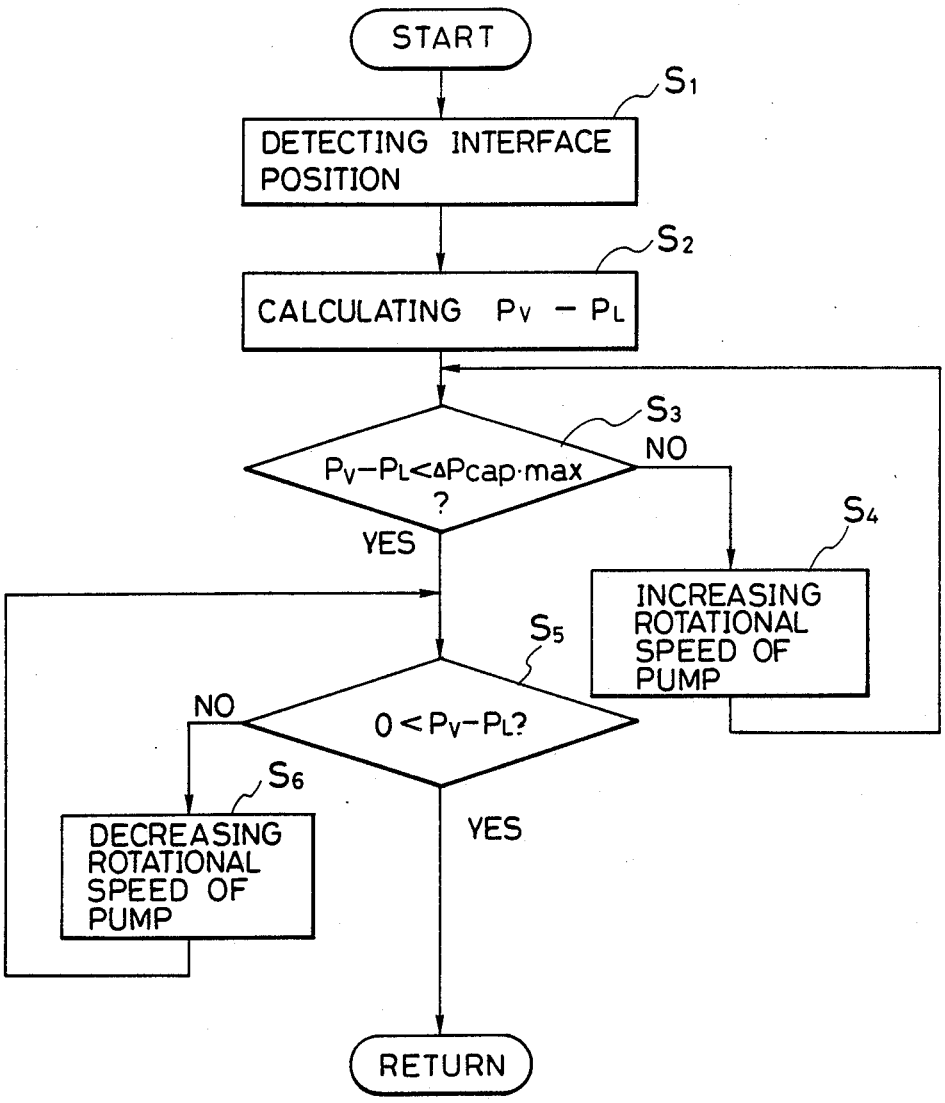
FIG. 8 is a control flow chart for controlling the flow rate of liquid flowing through a liquid transport pipe by use of the control means in FIG. 7.

The control by means of the control unit 27 will now be described with reference to the control flow chart shown in FIG. 8.

After start of the operation, the position of the liquid within the elongated pipe 21, i.e., the position of the interface between the vapor and the liquid is detected by the sensor 19 in step S1. The detection of the interface by the sensor 19 is carried out in the following manner;

The heater 25 is operated by a control signal from the control unit 27 and the entire elongated pipe 21 is being heated. The evaporation of the liquid in the elongated pipe 21 causes the temperature in the interface or border surface between the vapor and the liquid to lower. The temperature decrease in the border surface is detected by the plurality of thermocouples and an output signal corresponding to the interface position in the pipe 21 is produced from the sensor 19 and is applied to the control unit 27. The difference between the vapor pressure $P_V$ and the liquid pressure $P_L$, i.e., $P_V - P_L$ is calculated in the control unit 27 in accordance with the signal from the sensor 19 in step S2.

In this case, the interface between the vapor and liquid within the elongated pipe 21 is determined by a certain condition that the difference between the capillary force Δ Pcap of the elongated pipe 21 and the head $\Delta P_H$ due to the self weight of the liquid within the pipe 21 balances with the pressure difference between the liquid pressure $P_V$ and the vapor pressure $P_L$; Namely, the following equation is established.

$$\Delta Pcap - \Delta P_H = P_V - P_L \quad (3)$$

In this case, if the diameter of the pipe 21 is constant, the capillary force Δ Pcap becomes also constant, so that the pressure difference between $P_V$ and $P_L$ can be determined by the position of the interface between the liquid and the vapor in the pipe 21.

After this operation, it goes to step S3 where a decision is made whether or not the equation (1) is satisfied. In this case, when the rotational speed of the pump 7 is small although the evaporation is being carried out actively in the vapor channel 15 while the liquid pressure $P_L$ is smaller than the vapor pressure $P_V$ by a predetermined value, that is, if the result of the decision is No, the operation now moves to step S4. Namely, a decision is made if the pressure difference between the two is larger than the maximum capillary force Δ Pcap. max in step S3.

In step S4, a control signal for increasing the rotational speed of the pump 7 is produced from the control unit 27 to the pump 7, so as to increase the rotational speed of the pump by a predetermined rotational speed. After this operation, it returns to step S3 where the same decision is made about the equation (1). In this case, however, if the result of the decision is still NO, i.e., the pressure difference $P_V - P_L$ is still larger than the maximum capillary force Δ Pcap. max although the rotational speed of the pump has been increased in step S4, the control signal produced from the control unit 27 is again applied to the pump so as to increase the speed and this operation is repeated, until, the necessary condition is satisfied.

On the other hand, when the result of the decision in step S3 is YES, that is, the pressure difference $P_V - P_L$ is smaller than the Δ Pcap. max, the operation now moves to step S5 where another decision is made, i.e., the pressure difference is above zero about the equation (2). If the result of the decision in step S5 is NO, that is, if the liquid pressure $P_L$ is larger than the vapor pressure $P_V$ because of the rotational speed of the pump being larger than a predetermined value in the evaporation action, the pressure difference $P_V - P_L$ becomes negative and the equation (2) can not be satisfied. Accordingly, the operation goes to step S6 in this case.

In step S6, a control signal is produced from the control unit 27 to the pump 7, so as to decrease the rotational speed of the pump by a predetermined value. After this operation, it returns to step S5, where the same decision as described above is made. In this case, however, if the pressure difference $P_V - P_L$ is still below zero, in stead of having decreased the rotational speed of the pump, the step S6 is repeated.

On the other hand, when the result of the decision in step S5 is YES, i.e., the pressure difference $P_V - P_L > 0$, it is considered that the heat-pipe system is operated normally and the operation returns to the step S1.

By repeating each of the steps described above, both the vapor pressure $P_V$ and liquid pressure $P_L$ are suitably maintained, thus maintaining a suitable amount of the working fluid in the capillary structure of the vapor channel 15 and performing the operation of heat pipe with a high thermal transport efficiency.

As described in the foregoing, since the returning of the condensate from the condenser 1 to the evaporator 3 is performed by the driving of the pump 7, it is suitable to transport a large amount of heat load over long distances in the firs embodiment according the present invention.

Furthermore, since the pump 7 is not intermittently controlled but is continuously controlled in the number of rotations or rotational speed thereof by the control unit 27 and the control system as a whole can be strikingly simplified as well as improving the reliability and durability.

Moreover, since the heat-pipe system is controlled by the control unit 27 in response to the increase or decrease in the working fluid existing in the capillary structure of the vapor channel 15, the capillary structure is never dried out or excessively wet. In addition, it is to be understood that since the position of the liquid in the elongated pipe 21 is detected by the sensor 19, the pressure difference $P_V - P_L$ which is to be varied in accordance with the change in the working fluid in the capillary structure can be easily detected.

It is also appreciated that since the liquid position is detected by the detection of the lowering condition of the evaporated temperature in the liquid surface, an accurate detection of the liquid position can be reasized.

It is also to be noted that in order to detect the pressure difference of $P_V - P_L$ in the above embodiment, a micro pressure differential gauge having a strain gauge or bellows may be used as well. The flow rate of the liquid duct 5 can also be carried out by a throttle valve opening control, although not shown.

According to the present invention, it is also possible to directly heat the elongated pipe 21 as a whole so as to enable a more accurate detection of the liquid position, with thermal flow speed being constant.

Figure 9:
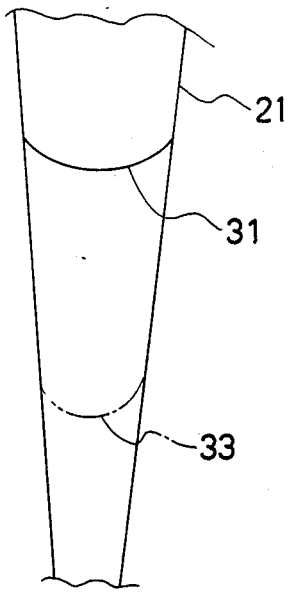
FIG. 9 illustrates part of the enlarged elongated pipe of the sensor, with a tape being formed, as another embodiment according to the present invention.

FIG. 9 shows another modification of the elongated pipe 21 shown in the above embodiment. In this case, the elongated pipe 21, is tapered. The tapered elongated pipe 21' is adapted to be used in a zero-gravity state such as cosmic space wherein the capillary force in the position of the interface 33 is larger than that of the interface position 31. Consequently, the pressure difference between the vapor pressure $P_V$ and the liquid pressure $P_L$ can also be calculated by the detection of the interface position therebetween in accordance with the relation Δ Pcap. max $= P_V - P_L$, which indicates that the pressure difference balances with the capillary force Δ Pcap, thus producing the same effect as that shown in FIG. 7 in the zerogravity state.

Figure 10:
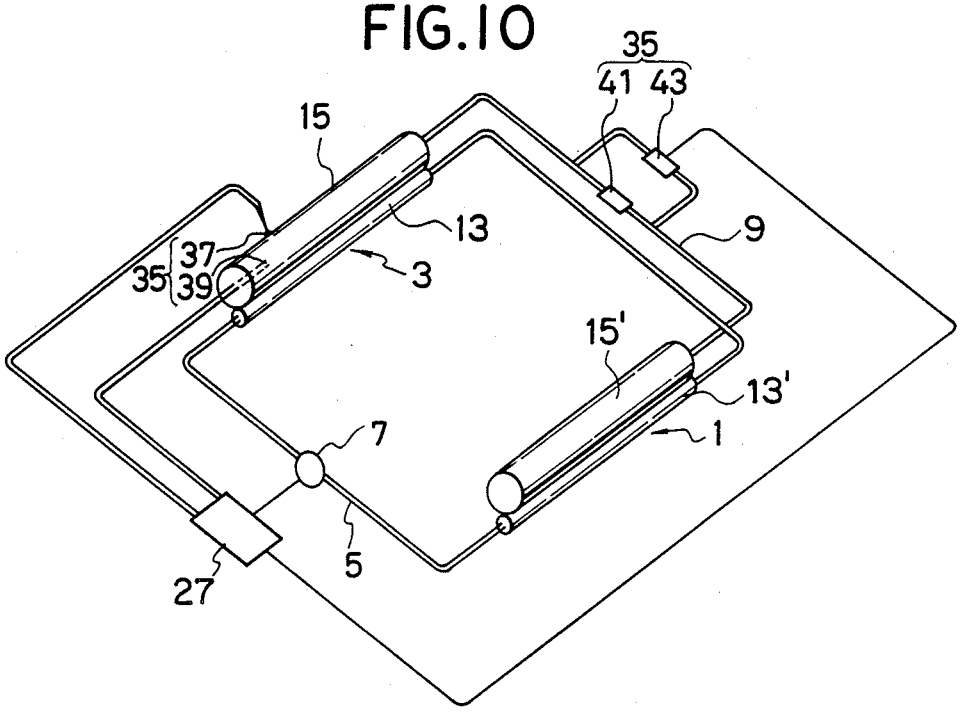
FIG. 10 is another embodiment of the heat-pipe system according to the present invention.

FIG. 10 shows a fourth embodiment according to the present invention in which the sensor 35 having the thermocouples detects a thermal conductivity $\alpha$ of the evaporator 3 through the detection of the temperature of the evaporator 3. Namely, the sensor 35 comprises thermocouples 37 and 39, provided at the evaporator 3, an orifice 41 provided at the vapor transport pipe 9 and a pressure difference gauge or meter 43. The thermocouple 37 is for detecting the temperature $T_W$ on the outer wall surface of the vapor channel 15 of the evaporator 3 while the thermocouple 39 is for detecting the vapor temperature $T_V$ in the vapor channel 15. The pressure difference gauge 43 as well as the thermocouples 37 and 39 are connected to the control unit 45.

The operation of this embodiment is as follows;

The basic operation of the heat-pipe system according to this embodiment is similar to the previous embodiment. Namely, after the start of the operation, the pressure difference of the orifice 41 is detected by the pressure differential gauge 43 in step S51 and the operation goes to step S52 where the vapor flow rate G is calculated in accordance with the pressure difference detected in the steps 51.

After this, the operation moves to step S53 where the wall surface temperature $T_W$ of the vapor channel 15 is detected by the thermocouples 37 and the operation now moves to step S54. In step S54, the vapor temperature $T_V$ of the evaporator 3 is detected by the thermocouple 39 and after this operation, it goes to step S55 where the calculation of the thermal conductivity $\alpha$ in the evaporator 3 is calculated in accordance with the following equation.

$$\alpha = \frac{\gamma G}{(T_W - T_V)A_V}$$

where $\gamma$=evaporation latent heat $A_V$=evaporation area

In step S56, the thermal conductivity $\alpha_{n-1}$ calculated previously is compared with the thermal conductivity $\alpha_n$ calculated at this time. Namely, a decision is made if $\alpha_{n-1}$ is equal to or larger than $\alpha_n$ in step S56. If the result of the decision is NO, i.e., if the relationship $\alpha_{n-1} < \alpha_n$ is established in the step S56, the operation returns to step S51 as it is indicated that the thermal conductivity $\alpha$ has been increased during the operation of the heat-pipe system. On the other hand, if the result of the decision in step S56 is YES, that is the relationship $\alpha_{n-1} \geqq \alpha_n$ is established in step S56, the thermal conductivity $\alpha$ is decreased or stopped. In this case, accordingly, as the rotational speed control of the pump is required, the operation moves to step S57 where another decision is made whether the decrease in the thermal conductivity $\alpha$ is rapid or not.

If the result of the decision is YES, that is, the decrease in the thermal conductivity $\alpha$ is rapidly carried out, it is considered that the thermal conductivity $\alpha$ is decreased larger than a suitable amount of the working fluid in the vapor channel 15 of the evaporator and the operation now moves to step S58.

In step S58, a control signal for increasing the rotational speed of the pump 7 is produced by the control unit 45 to the pump 7. Accordingly, the rotational speed of the pump 7 is increased by a predetermined value and the condensate to be returned to the evaporator 3 is increased.

If, on the other hand, the result of the decision in step S57 is NO, i.e., the decrease in the thermal conductivity $\alpha$ is rather slow, it is considered that an excessive working fluid is supplied into the vapor channel 15, so that the operation now goes to step S59 where another control signal is produced from the control unit 45 so as to decrease the rotational speed of the pump. Consequently, the actual rotational speed of the pump is decreased by a predetermined value, thus realizing the decrease in the condensate to be supplied to the evaporator 1.

By repeating each of the above steps, a suitable amount of the working fluid is maintained in the capillary structure in the vapor channel 15 and the operation of the heat-pipe system can be performed with a high thermal conductivity. In addition, since the control is performed by seeking the thermal conductivity in this embodiment according to the present invention, a more direct control can be carried out. The same effects as those of the third embodiment can be obtained.

Figure 12:
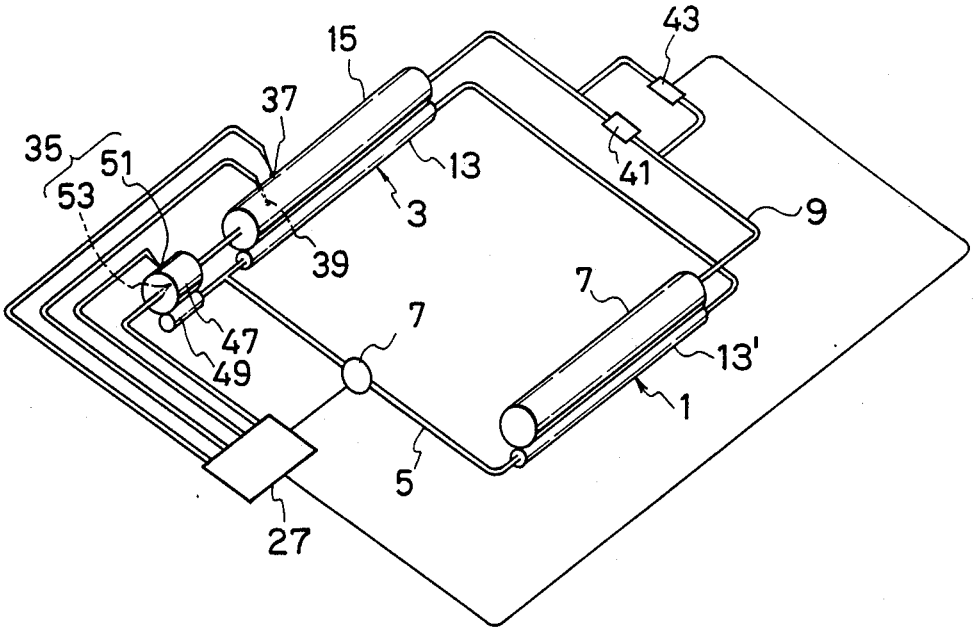
FIG. 12 is still another embodiment of the heat-pipe system according to the present invention.

FIG. 12 shows a fifth embodiment according to the present invention. In this embodiment, the provision is made of another small vapor channel 47 which communicates with the vapor channel 15 of the evaporator 3 and a small liquid channel 49 which communicates with the liquid channel 13. The small vapor channel 47 comprises a capillary structure having a capillary dimension which is larger than that of the capillary structure of the vapor channel 15. A plurality of thermocouples 51 and 53 are also provided, which correspond to those 37 and 39 of the thermocouples mounted to the vapor channel 15 and they are evaporated to the control unit 45.

Figure 11:
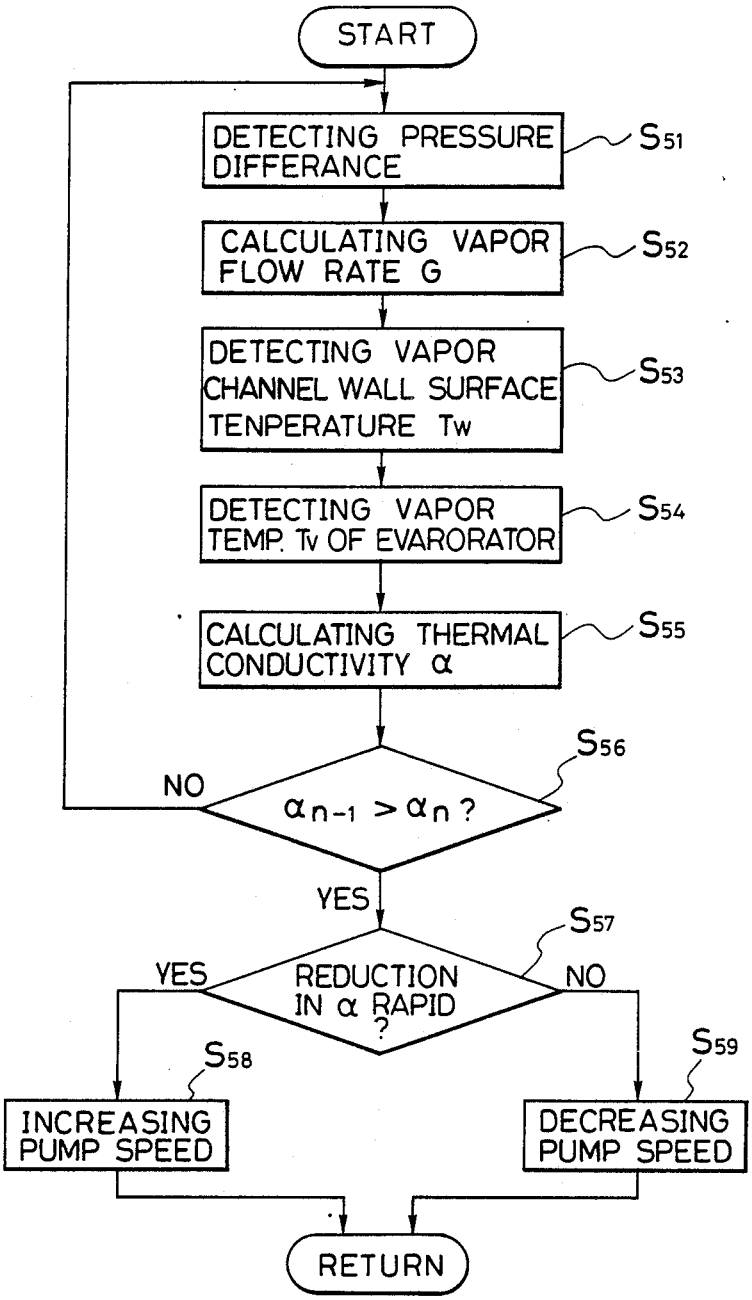
FIG. 11 is a control flow chart for controlling the heat-pipe system of FIG. 10, according to the present invention.

The action of this embodiment is carried out in the similar manner as that of the fourth embodiment shown in FIG. 10, except that the decision in step S57 in the control flow chart of FIG. 11 is performed by monitoring the thermal conductivity of the vapor channel 15 and that of the small vapor channel 47. In other words, when the thermal conductivity of the evaporation surface of the small vapor channel 47 having a large capillary dimension is decreased firstly, it is determined that the liquid is not sufficient, while both the thermal conductivit are decreased at the same time, it is determined that the liquid is excessive. Consequently, the same effects as those of the fourth embodiment can be produced as well as enabling an accurate decision to be performed whether or not the decrease in the thermal conductivity is due to the unsufficient liquid or due to the excessive liquid condition.

The description has been made in the fifth embodiment that the changes both in the thermal conductivity are monitored by the provision of a small vapor channel 47 as well as the vapor channel 15, it may also be possible that a provision is made of two small vapor channels as well as the vapor channel 15, together with different capillary structures having different dimensions respectively, and the same effects as described above may also be produced by monitoring the changes in both the thermal conductivities.

Figure 13:
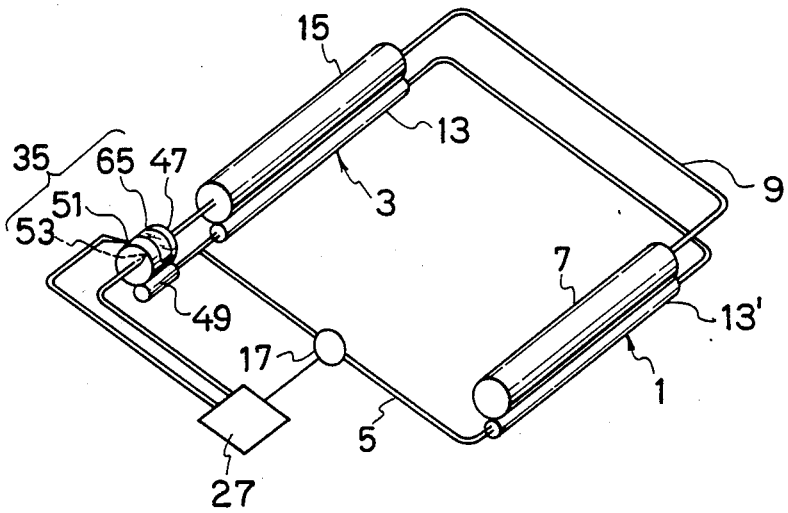
FIG. 13 shows still another embodiment of the heat-pipe system according to the present invention.

FIG. 13 shows a sixth embodiment of the heat-pipe system according to the present invention. This embodiment corresponds to the fourth embodiment and there is provided both small vapor channel 47 and liquid channel 49 with thermocouples 51 and 53 provided along the small vapor channel 47 together with a heater 65. In this case, therefore, the thermal conducitivity $\alpha$ in this embodiment can be calculated in accordance with the following equation;

$$\alpha = \frac{Q}{(T_W - T_V)A}$$

where

Q=thermal quantity of the heater 65

A=evaporation area of the heater

In this embodiment, the same effects as those produced in the fourth embodiment can be produced as well as enabling the vapor transport pipe 9 to be simplified.

As described in the foregoing embodiments according to the present invention, it is possible to transport a large amount of heat over long distances since the driving force to the condensate is imparted by a pump.

Moreover, since factors of fluctuation are detected and are controlled in accordance with the increase or decrease in the liquid amount existing in the capillary structure in the evaporator, a suitable amount of the liquid condensate can be supplied to the evaporator in accordance with the evaporated amount of the liquid.

In addition, since the condensate control is performed by a continuous flow rate control in the present invention, a control mechanism and control system can be simplified compared with the intermittent operation of the system according to the prior art, thus strickingly improving the reliability as well as durability.

While the invention has been described in its preferred embodiments, it is to be understood that the words which have been used are words of description rather than limitation and that various changes and modifications may be made within the purview of the appended claims without departing from the true scope and spirit of the invention in its broader aspects.

What is claimed is:

1. A heat-pipe system which comprises:

an evaporator having a first capillary structure for evaporating a working fluid;

a condenser having a second capillary structure for condensing vapor evaporated in said evaporator into liquid condensate so as to return it to the evaporator through a liquid duct;

a vapor transport pipe communicating between vapor channels of said evaporator and said condenser for transporting the vapor evaporated in the evaporator;

a pump provided at the liquid duct for driving the working fluid therethrough;

sensor means for detecting the change in the amount of liquid in the capillary structure of the evaporator in accordance with the pressure difference between vapor pressure in the vapor channel and liquid pressure in the liquid channel of the evaporator; and control unit means having a CPU, a ROM, and a RAM, connected between said pump and said sensor means for controlling the rotational speed of the pump in accordance with a detected signal from said sensor means so as to optimally control the amount of the liquid remaining in the capillary structure of the evaporator by controlling a flow rate of the liquid flowing through the liquid duct.

2. The heat-pipe system as claimed in claim 1 wherein said sensor means further comprises an elongated pipe, one end of which is communicated with vapor in the vapor channel and the other end of which is communicated with liquid in the liquid channel in the evaporator, a plurality of thermocouples provided along the elongated pipe, and a heater provided along said elongated pipe so as to heat the pipe.

3. The heat-pipe system as claimed in claim 4 wherein said elongated pipe is tapered so as to more easily detect the position of interface between the vapor and the liquid in the elongated pipe in a zero gravity state such as in the cosmic space.

4. A method of controlling a flow rate of a working fluid in a liquid duct of a heat-pipe system, paticularly an arterial heat-pipe system having evaporator and condenser, which comprises the steps of:

detecting the position of interface between vapor and liquid in an elongated pipe of a sensor means for detecting the liquid amount;

calculating $P_V - P_L$ from the difference between capillary force Pcap in the elongated pipe of the sensor means and head height due to the self weight of the liquid in the elongated pipe (where $P_V$=vapor pressure in the vapor channel and $P_L$=liquid pressure in the liquid channel of the evaporator);

determining if $P_V - P_L <$ Pcap. max is found (where Pcap. max=maximum capillary force in the vapor channel of the evaporator);

increasing the rotational speed of a pump provided at the liquid duct if the result of said determination is NO and repeating this operation until it reaches a desired result;

determining if $0 < P_V - P_L$ is found, in accordance with the result of said first determination, i.e., YES is found;

decreasing the rotational speed of the pump if the result of the last determination is NO, i.e., $0 \geqq P_V - P_L$ is found; and returning the operation to the first step of detecting the position of interface when the last determination is YES, that is, $0 < P_V - P_L$ is found, thereby optimally controlling the amount of liquid remaining in the capillary structure of the evaporator.

* * * * *